US005400232A

United States Patent [19]

Wong

[11] Patent Number: 5,400,232

[45] Date of Patent: Mar. 21, 1995

[54] VIBRATION FLASHLIGHT

[76] Inventor: Oscar Wong, No. 160-49, Sec. 3, Hsi Twen Rd., Hsi Twen Dist., Taichung, Taiwan, Prov. of China

[21] Appl. No.: 54,749

[22] Filed: Apr. 27, 1993

[51] Int. Cl.[6] ..... F21L 7/00

[52] U.S. Cl. ..... 362/276; 362/198; 362/200; 362/800

[58] Field of Search ..... 362/103, 184, 200, 205, 362/249, 276, 196, 390, 394, 800, 802, 806, 190; 36/137

[56] References Cited

U.S. PATENT DOCUMENTS

| | | | |
|---|---|---|---|
| 2,370,601 | 2/1945 | Wimpfheimer et al. | 362/103 |
| 2,816,284 | 12/1957 | Campanell | 362/103 |
| 4,128,861 | 12/1978 | Pelengaris | 362/103 |
| 4,435,743 | 3/1984 | Plumly | 362/276 |
| 4,754,378 | 6/1988 | Chen | 362/200 |
| 4,867,927 | 9/1989 | Lanius | 362/802 |
| 5,058,900 | 10/1991 | Denen | 362/800 |

FOREIGN PATENT DOCUMENTS

| | | | |
|---|---|---|---|
| 0335467 | 10/1989 | European Pat. Off. | 36/137 |
| 2608485 | 9/1977 | Germany | 36/137 |

*Primary Examiner*—Ira S. Lazarus
*Assistant Examiner*—Y. Quach
*Attorney, Agent, or Firm*—Trask, Britt & Rossa

[57] ABSTRACT

A vibrational flashlight having a housing for containing a battery and at least one light emitting diode having a first lead connected to a spring and a second lead sited against the second electrode of the battery. The spring oscillates for periodically contacting the first electrode of the battery when the vibrational flashlight is subjected to vibration.

2 Claims, 1 Drawing Sheet

VIBRATION FLASHLIGHT

BACKGROUND OF INVENTION

1. Field of Invention

The present invention relates to a vibration flashlight.

2. Related Prior Art

Vibration flashlights have been incorporated by means of sport shoes or bicycles. The vibrational flashlights twinkle for warning or better indication when the sport shoes or bicycles are moved. In the past, conventional vibrational flashlights employed mercury switches for the flowability and electrical conductivity of mercury. But, the mercury switches must be fiercely shaken in order to sufficiently oscillate mercury contained therein. To cooperate with mercury switches, complicated circuits must be employed. Furthermore, as mercury is toxic, there can be serious environmental problems when the mercury switches are disposed together with used sport shoes or bicycles.

Therefore, the present invention is intended to solve the above-mentioned problems.

SUMMARY OF INVENTION

It is an object of the present invention to provide a vibrational flashlight having a housing for containing a battery and at least one light emitting diode having a first lead connected to a spring and a second lead sited against the second electrode of the battery. The spring oscillates to periodically contact the first electrode of the battery when the vibrational flashlight is subjected to vibration.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
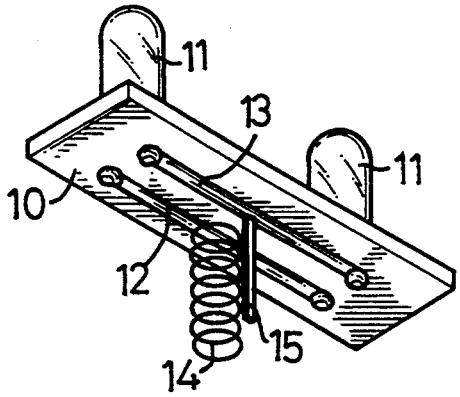
FIG. 1 is a bottom-front-right perspective view of a vibrational flashlight in accordance with the preferred embodiment of the present invention.

Initially referring to FIG. 1 of the drawings, a vibrational flashlight has an electrically isolating plate 10 having a first series of holes (not shown) formed therethrough and a second series of holes (not shown) formed therethrough. The plate 10 has a first side on which at least one, e.g., two, light emitting diodes 11 are mounted and a second side on which two electrically conductive lines 12 and 13 are printed. The electrically conductive line 12 is formed along the first series of holes and the electrically conductive line 13 is formed along the second series of holes.

The light emitting diodes 11 each have a first lead and a second lead. The first leads of the light emitting diodes 11 are inserted through the first series of holes in order to be welded to the electrically conductive line 12 and the second leads of the light emitting diodes 11 are inserted through the second series of holes in order to be welded to the electrically conductive line 13. The electrically conductive line 12 is also connected to an electrically conductive spring 14. The electrically conductive line 13 is also connected to a slender electrically conductive member 15.

Figure 2:
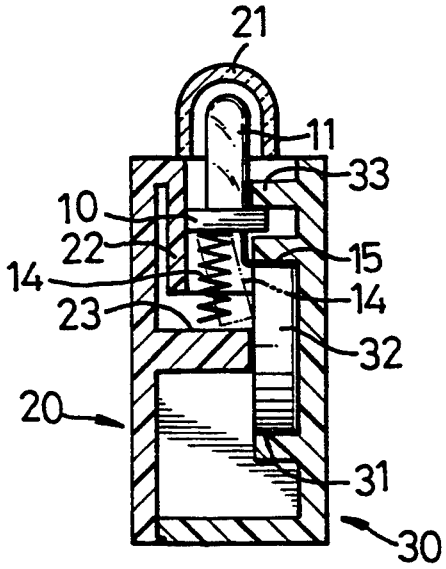
FIG. 2 is a vertical cross-sectional view of a vibrational flashlight in accordance with the preferred embodiment of the present invention.

Additionally referring to FIG. 2 of the drawings, an electrically isolating housing consists of a first member 20 and a second member 30.

The first member 20 has a first side and a second side. The first member 20 is integral with a strip 22 arranged parallel to the second side of the first member 20. The first member 20 has an upper rim integrating with an upper rim of the strip 22. A protrusion 23 is perpendicularly formed on the second side of the first member 20.

The second member 30 has a first side and a second side. A cylindrical portion 31 is formed on the first side of the second member 30. A shoulder 33 is formed on the first side of the second member 30.

The plate 10 is sited between the first member 20 and the second member 30. The plate 10 has a first rim sited against the strip 22 and a second rim sited between the cylindrical portion 31 and the shoulder 33. The light emitting diodes 11 are sited against the shoulder 33. Thus, the plate 10 and the light emitting diodes 11 are firmly mounted between the first member 20 and the second member 30. The slender electrically conductive member 15 is inserted in the cylindrical portion 31.

A battery 32 is sited in the cylindrical portion 31. The battery 32 has a disk-shaped form having a periphery, a first side and a second side. The first side of the battery 32 is sited against the tip of the protrusion 23 and the second side of the battery 32 is sited against the first side of the second member 30. Thus, the battery 32 is firmly mounted between the first member 20 and the second member 30. The electrically conductive member 15 contacts the periphery of the battery 32.

The first member 20 can be adhered to the second member 30 so that the housing is assembled. A transparent mask 21 is attached on the housing such that the diodes 22 are enclosed by means of the mask 21.

The periphery of the battery 32 is the cathode of the battery and the first side of the battery 32 is the anode of the battery 32. When the spring 14 is subjected to vibration, it is oscillated so that it contacts the first side of the battery 32 periodically. Each time the spring 14 contacts the first side of the battery 32, the light emitting diodes 11 are turned on. Thus, the flashlight twinkles when it is subjected to vibration.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A vibrational flashlight comprising:

a housing for containing a battery which has a fast electrode and a second electrode, said housing comprising a first member on which a protrusion is formed and a second member on which a cylindrical portion is formed, said battery being mountable in said cylindrical portion to rest against said protrusion such that said battery is firmly mounted in said housing;

at least one light emitting diode;

a spring;

a conductive member positioned to rest against the second electrode of said battery; and connecting means for electrically connecting said light emitting diode to said spring and said conductive member;

whereby said spring oscillates for periodically contacting the first electrode of said battery when said vibrational flashlight is subjected to vibration.

2. A vibrational flashlight comprising:

a housing for containing a battery which has a first electrode and a second electrode, said housing comprising a first member on which a protrusion is formed and a second member on which a cylindrical portion is formed, said battery being mounted in said cylindrical portion and bearing against said protrusion such that said battery is firmly mounted in said housing;

an electrically isolating plate mounted in said housing and comprising a first series of holes formed therethrough and a second series of holes formed therethrough;

a first electrically conductive line printed on an underside of said isolating plate along said first series of holes;

a second electrically conductive line printed on the underside of said isolating plate along said second series of holes;

a plurality of light emitting diodes each comprising a pair of first and second leads, said first leads being inserted through said first series of holes and connected to said first electrically conductive line and said second leads being inserted through said second series of holes and connected to said second electrically conductive line;

a slender electrically conductive member comprising a first end connected to said second electrically conductive line and a second end resting against the second electrode of said battery; and a spring mounted in said housing and comprising a first end connected to said first electrically conductive line and a second end which oscillates so as to periodically contact the first electrode of said battery when said vibrational flashlight is subjected to vibration.

* * * * *